United States Patent [19]

Schoenwald

[11] 4,376,613

[45] Mar. 15, 1983

[54] SIDE CHANNEL COMPRESSOR

[75] Inventor: Klaus Schoenwald, Bad Neustadt, Fed. Rep. of Germany

[73] Assignee: Siemens Aktiengesellschaft, Berlin and Munich, Fed. Rep. of Germany

[21] Appl. No.: 882,760

[22] Filed: Mar. 2, 1978

[30] Foreign Application Priority Data

Mar. 31, 1977 [DE] Fed. Rep. of Germany ..... 2714459

[51] Int. Cl.[3] ..... F04D 5/00

[52] U.S. Cl. ..... 415/53 T; 415/119; 415/213 T

[58] Field of Search ..... 415/53 T, 213 T, 119

[56] References Cited

U.S. PATENT DOCUMENTS 3,280,752 10/1966 Luhmann ..... 415/213 T 3,849,024 11/1974 Massai et al. ..... 415/53 T 4,006,998 2/1977 Schonwald ..... 415/213 T

FOREIGN PATENT DOCUMENTS 583053 10/1958 Italy ..... 415/53 T

*Primary Examiner*—Edward K. Look

*Attorney, Agent, or Firm*—Kenyon & Kenyon

[57] ABSTRACT

An improved side channel compressor wherein the compressor has a side channel with inlet and outlet openings and a rib projecting in the axial direction into the channel and wherein the improvement comprises providing that the rib have a height which is from 10 to 25 percent of the depth of the side channel and arranging the rib approximately mid-way between the inlet and outlet openings.

4 Claims, 2 Drawing Figures

SIDE CHANNEL COMPRESSOR

BACKGROUND OF THE INVENTION

1. Field of the Invention

The invention relates to a side channel compressor having a side channel into which at least one rib projects in the axial direction.

2. Description of the Prior Art

In one known side channel compressor of the above type, the ribs in the side channel are employed to influence the output characteristics of the compressor. Thus, the ribs extend substantially in the circumferential direction of the side channel and occupy only the radially central region of the side channel. In addition, these ribs must project as far as possible toward the rotor of the compressor in order to achieve the desired flow effect.

In side channel compressors there frequently occurs, in addition to the turbulence noise generated by the turbulent components of the flow and the siren noise caused by the interaction between the rotor vanes and the interrupter edges, noise due to cavity resonances of the side channel. While many techniques are known for attenuating the turbulence and siren noises, no simple and effective solution has yet been found for attenuating the noises generated by cavity resonance.

It is, therefore, an object of the present invention to provide a side channel compressor designed so as to attenuate the noise generated in the compressor by cavity resonance in the side channel.

SUMMARY OF THE INVENTION

In accordance with the principles of the present invention the above and other objectives are realized in a side channel compressor of the above type by further providing therein a rib having a height approximately 10 to 25 percent of the depth of the side channel, and arranged approximately mid-way between the inlet and outlet openings of the side channel. With the compressor so formed, the rib provides a detuning effect which substantially prevents the occurrence of cavity resonances in the side channel. Moreover, the rib can be formed-on directly when the side channel compressor housing is made, so that the addition of the rib requires no significant additional expense.

Advantageously, a further improvement of the noise attenuation is achieved with the compressor of the invention by extending the rib over the full radial circumference of the said channel and by providing that the rib have an angular cross section. More particularly, the turbulence generated at the corners of such a rib is found to enhance the attenuation effect of the rib.

A particularly simple arrangement of the side channel compressor of the invention can be realized by arranging the rib so that it is exactly mid-way between the inlet and the outlet openings. In such case, the side channel compressor can be configured for one or the other directions of rotation without the necessity of making changes to realize the desired noise attenuation. Moreover, equal attenuation for both directions of rotation can be achieved by extending the rib in a meridian plane of the compressor. In addition, this arrangement of the rib provides an optimum attenuation effect.

BRIEF DESCRIPTION OF THE DRAWING

The above and other features and aspects of the present invention will become apparent upon reading the following detailed description in conjunction with the accompanying drawings in which.

DETAILED DESCRIPTION

Figure 1:
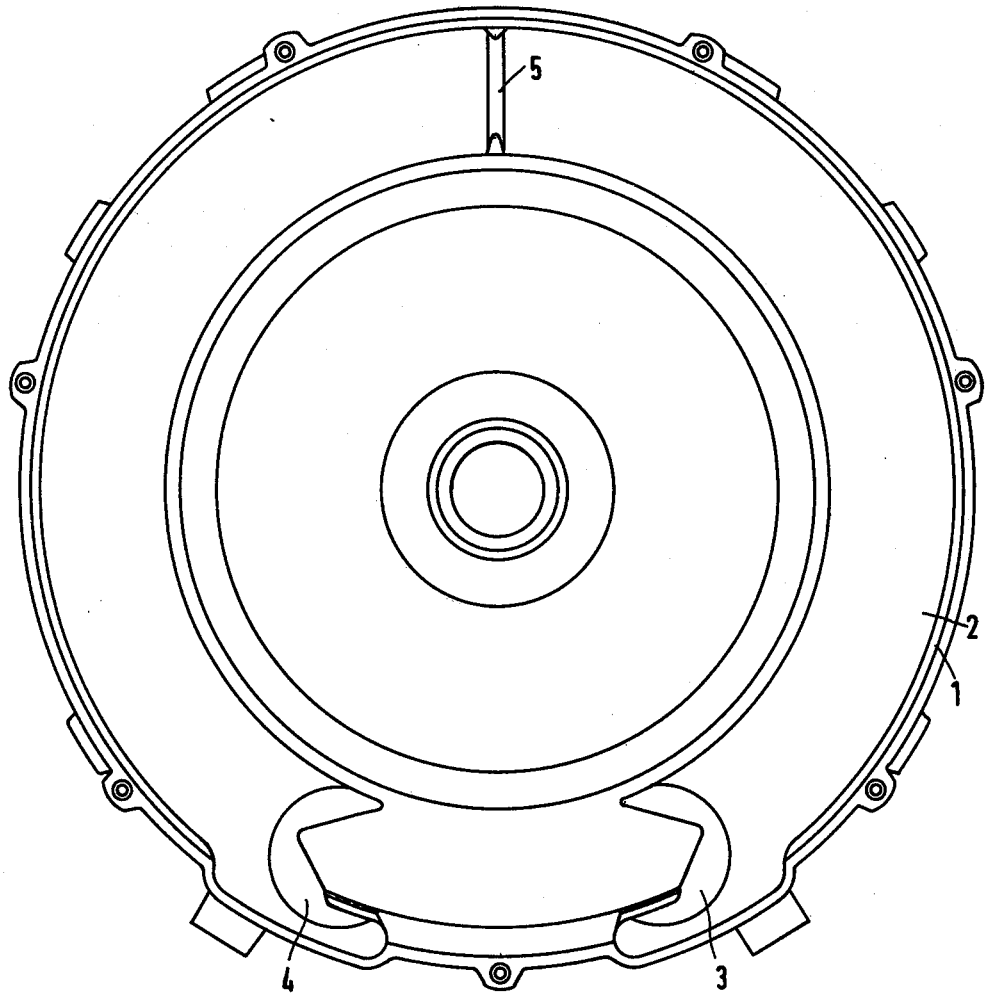
FIG. 1 shows a top view of one half of the housing of a side channel compressor in accordance with the principles of the present invention.

In FIG. 1 the housing half 1 of a side channel compressor is provided with a side channel 2 having an inlet opening 3 and on outlet opening 4. In the side channel 2, a rib 5 having a height from 10 to 25 percent of the depth of the side channel is arranged approximately mid-way between the inlet and outlet openings 3 and 4, respectively. Rib 5 can be characterized as having a triangular cross-section and a rounded tip as clearly shown in FIG. 1. As shown, the rib 5 has an angular cross section and extends over the full radial circumference of the side channel 2 (See, FIG. 2).

If the other housing half of the side channel compressor is also provided with a side channel then a rib similar to rib 5 will likewise be arranged in that side channel.

Figure 2:
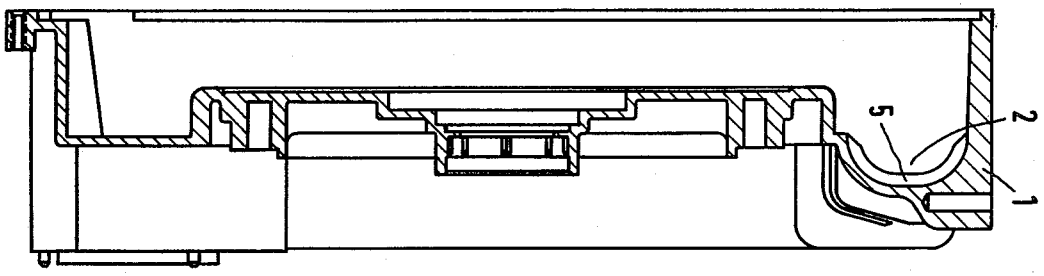
FIG. 2 illustrates a longitudinal cross section of the housing half shown in FIG. 1.

In the illustrative embodiment of the side channel compressor shown in FIGS. 1 and 2 only a single rib is provided in the side channel and this rib is arranged exactly mid-way between the inlet and the outlet openings 3 and 4, respectively. However, it is also possible to provide several ribs 5 in the channel and to arrange the ribs approximately mid-way, i.e. in the middle third of the circumference, between the inlet and outlet openings 3 and 4. By selecting the height of the ribs, as above-described, their height will be small relative to the depth of the side channel and, hence, the ribs will produce no appreciable flow losses.

Optimum attenuation is provided if the rib 5 extends in the respective meridian plane of the side channel compressor. If the rib is arranged symmetrically to the middle of the channel between the inlet and the outlet openings, the compressor can be designed for both directions of rotation without change. The attenuation effect will then be equally good in both directions of rotation.

What is claimed is:

1. In a side channel compressor of the type having a side channel within an inlet and outlet opening and at least one rib projecting into the side channel in the axial direction of the compressor, the improvement comprising:

said rib having a substantially triangular cross section and being arranged in a direction substantially transverse to said side channel approximately mid-way between said inlet and outlet openings and having a height which is approximately 10 to 25% of the depth of said side channel, whereby cavity resonances in the side channel are substantially attenuated.

2. In a side channel compressor of the type having a side channel within an inlet and outlet opening and at least one rib projecting into the side channel in the axial direction of the compressor, the improvement comprising:

said rib extending in the meridian plane of said side channel compressor and being arranged in a direction substantially transverse to said side channel exactly mid-way between said inlet and outlet openings and having a height which is approximately 10 to 25% of the depth of said side channel, whereby cavity resonances in the side channel are substantially attenuated.

3. In a side channel compressor in accordance with claim 1 or 2, the improvement wherein:

said rib extends over the full radial circumference of said side channel.

4. In a side channel compressor in accordance with claim 1, the improvement wherein:

said rib is arranged exactly mid-way between said inlet and outlet openings.

* * * * *